US005732623A

United States Patent [19]

Compera et al.

[11] Patent Number: 5,732,623

[45] Date of Patent: Mar. 31, 1998

[54] PRINTING PRESS WITH RECTILINEAR SUBSTRATE TRANSPORT AND TURNING DEVICES THEREFOR

[75] Inventors: Christian Compera, Dossenheim; Martin Greive, Heidelberg; Bernd Herrmann, Malsch; Anton Rodi, Leimen, all of Germany

[73] Assignee: Heidelberger Druckmaschinen AG, Heidelberg, Germany

[21] Appl. No.: 686,816

[22] Filed: Jul. 26, 1996

[30] Foreign Application Priority Data

Jul. 26, 1995 [DE] Germany ..... 195 27 264.1

[51] Int. Cl.[6] ..... B41F 13/24

[52] U.S. Cl. ..... 101/232; 271/187

[58] Field of Search ..... 101/229, 230, 101/231, 232, 240, 409, 407.1, 415.1, 177; 271/225, 226, 248, 264, 82, 184, 187, 109, 113

[56] References Cited

U.S. PATENT DOCUMENTS

| | | | |
|---|---|---|---|
| 1,778,272 | 10/1930 | Oertel | 101/230 |
| 2,784,831 | 3/1957 | Connell . | |
| 3,664,261 | 5/1972 | Dahlgren | 101/177 |
| 3,838,771 | 10/1974 | Whiteford . | |
| 4,411,350 | 10/1983 | Wolfram . | |
| 4,449,450 | 5/1984 | Barry et al. | 101/232 |
| 4,567,824 | 2/1986 | Dahlgren et al. | 101/232 |
| 4,669,715 | 6/1987 | Jeschke . | |
| 4,711,172 | 12/1987 | Capdebose . | |
| 4,798,278 | 1/1989 | Cornacchia . | |
| 4,915,025 | 4/1990 | Miyazaki . | |
| 4,939,992 | 7/1990 | Bird . | |
| 5,046,711 | 9/1991 | Merwarth et al. | 271/187 |
| 5,277,413 | 1/1994 | Boss | 271/187 |
| 5,392,710 | 2/1995 | Li . | |
| 5,444,525 | 8/1995 | Takahashi et al. | 101/211 |

FOREIGN PATENT DOCUMENTS

| | | | |
|---|---|---|---|
| 310 639 | 10/1973 | Austria . | |
| 0 256 991 | 2/1988 | European Pat. Off. . | |
| 0 627 376 A1 | 12/1994 | European Pat. Off. . | |
| 0 637 561 A1 | 2/1995 | European Pat. Off. . | |
| 0 676 344 A1 | 10/1995 | European Pat. Off. . | |
| 2252922 | 8/1975 | France | 101/230 |
| 558 976 | 9/1932 | Germany . | |
| 917 764 | 7/1954 | Germany . | |
| 1 047 713 | 12/1958 | Germany . | |
| 1 239 624 | 4/1967 | Germany . | |
| 19 30 317 | 1/1970 | Germany . | |
| 1 582 968 | 10/1970 | Germany . | |

(List continued on next page.)

OTHER PUBLICATIONS

"Apparatus for printing synthetic foils continuously on both the upper and the lower side" (Kähler), dated Jan. 7, 1958, pp.1–4.

Apparatus for accepting and transporting single–fed rods, webs, plates and boards etc., in particular roller articles, dated Jun. 14, 1963, pp. 1–20.

*Primary Examiner*—Eugene H. Eickholt

*Attorney, Agent, or Firm*—Herbert L. Lerner; Laurence A. Greenberg

[57] ABSTRACT

A printing press has a plurality of in-line printing units in which substrates are transported along a rectilinear transport path. The printing units include several recto printing units and several verso printing units disposed along the transport path. A transport system, which transports the substrates through the printing units along the straight transport path, includes a first transport apparatus through the recto printing units, and a second transport apparatus through the verso printing units. A feeder assembly feeds the substrates to be printed from a feeder pile to the transport system. The feed by the feeder also follows a straight path which is coplanar with the path through the printing units. It is thus possible to print not only bendable substrates, but also rigid and stiff substrates such as carton, plastic, sheet metal, glass, and the like. The system further includes a turning apparatus for turning the substrates between the recto printing units and the verso printing units.

3 Claims, 5 Drawing Sheets

FOREIGN PATENT DOCUMENTS

| | | |
|---|---|---|
| 2 237 567 | 2/1974 | Germany . |
| 31 15 925 C1 | 12/1982 | Germany . |
| 34 44 848 A1 | 6/1986 | Germany . |
| 29 43 260 A1 | 5/1987 | Germany . |
| 39 40 614 C2 | 6/1991 | Germany . |
| 41 07 464 A1 | 9/1992 | Germany . |
| 587 513 | 10/1993 | Germany . |
| 43 44 260 A1 | 6/1995 | Germany . |
| 44 43 031 A1 | 6/1995 | Germany . |
| 2 096 975 | 10/1982 | United Kingdom . |

PRINTING PRESS WITH RECTILINEAR SUBSTRATE TRANSPORT AND TURNING DEVICES THEREFOR

BACKGROUND OF THE INVENTION

Field of the Invention

The invention relates to a printing press with a plurality of in-line printing units, with a transport system for the rectilinear transport of substrates to be printed through the printing units, and with a feeder at which the substrates are stacked for transferring the substrates to the transport system, and to suitable turning devices therefor.

In conventional printing presses, the transport path of the substrates or sheets through the printing press is, for structure-inherent reasons, often a curved path. A desirable side effect is thereby that the sheets, during their being transported along the path, are stabilized.

There has become known from German patent DE-PS 19 30 317 a printing press of the above-noted type in which the sheets are transported in a single gripper closure in a horizontal plane through a plurality of consecutive printing units. That type of sheet transport is partially based on the requirement that the transport system for transporting the sheets through the printing units should operate so as to be as free as possible from inertial forces.

SUMMARY OF THE INVENTION

It is accordingly an object of the invention to provide a printing press with rectilinear sheet transport and turning devices therefor, which overcomes the above-mentioned disadvantages of the heretofore-known devices and methods of this general type and which is more versatile in use than conventional printing presses.

With the foregoing and other objects in view there is provided, in accordance with the invention, a printing press, comprising:

- a plurality of in-line printing units defining a substantially rectilinear transport path;
- a transport system for transporting substrates for printing in the printing units along the transport path;
- a feeder assembly for feeding the substrates to be printed to the transport system, the feeder assembly including a feeder for transferring individual substrates from a feeder pile on which the substrates to be printed are stacked to the transport system, the feeder defining a feeder transport path of the substrates from the feeder pile to the transport system, the feeder transport path being rectilinear and substantially coplanar with the transport path in the printing units.

In accordance with an added feature of the invention, the feeder for transferring the substrates to the transport system comprises a substrate-removal device and at least one pair of transfer rollers, the substrate-removal device and the transfer rollers being disposed directly adjacent the feeder transport path.

In accordance with an additional feature of the invention, the printing press further comprises a delivery defining a delivery transport path along which the substrates enter the delivery, the delivery including at least one of a pair of transfer rollers and a braking apparatus disposed immediately adjacent the delivery transport path, the delivery transport path being substantially coplanar with the transport path of the substrates through the printing units.

In other words, the objects of the invention are achieved in a printing press of the above-mentioned kind in that the transfer of the substrates from the feeder pile to the transport system is rectilinear and is in the same plane as the transport path of the substrates into the printing units.

With the printing press according to the invention it is possible to print not only flexible materials such as paper, but also materials such as cardboard, plastic, sheet metal, glass etc., which, owing to their thickness or their material properties, cannot or must not be deformed. With conventional printing presses it was not possible to print non-deformable substrates; nor was this possible with the above-mentioned printing press known from DE-PS 19 30 317. It is essentially important in that printing press only that the sheets be transported along a flat transport path through the printing units. It can therefore be presumed that use will be made of conventional feeders in which, normally, there is at least a slight deformation of the sheet.

According to the invention, the feeder is incorporated into the flat transport path in that the substrates are, in one plane, removed from the feeder pile, accelerated and sent on the transport path through the printing units. The delivery may, in a similar manner, be incorporated into the flat transport path in that the substrates are deposited rectilinearly on the delivery pile, which is kept at a suitable height. Alternatively, the top side of the delivery pile may be lower than the exit point of the substrates from the printing units. The substrates—after having been braked, where appropriate, by a braking apparatus—thereby drop onto the delivery pile.

The system according to the invention therefore allows substrates of any thickness and even very stiff or even brittle substrates to be printed quickly and in large numbers, e.g. in offset printing. The prior art has accepted as self-evident that such printing is not possible with conventional printing presses, and such substrates have been printed using other, economically less efficient printing processes.

In accordance with a further feature of the invention, the plurality of printing units includes a series of recto printing units and a series of verso printing units, and the transport system includes a first transport apparatus for transporting the substrates from the feeder through the series of recto printing units, and a second transport apparatus disposed behind the first transport apparatus as seen along the transport path for transporting the substrates through the series of verso printing units.

In accordance with again a further feature of the invention, transfer rollers of the recto printing units and transfer rollers of the verso printing units are disposed on mutually opposite sides of the transport path, and the first and second transport apparatus adjoin each other at a transfer point for transferring the substrates from the first transport apparatus to the second transport apparatus, the transfer point lying on the transport path of the substrates between the recto printing units and the verso printing units. Conversely, the transfer rollers of the recto printing units and of the verso printing units may be disposed on the same side of the transport path of the substrates through the printing units, and including a turning apparatus for turning the substrates disposed between the first transport apparatus and the second transport apparatus.

In accordance with a further feature of the invention, each of the transport apparatus encompasses at least one endless conveyor belt, each of the endless conveyor belts comprising a rectilinear strand extending along the transport path of the substrates through the printing units, the substrates lying in flat contact on the rectilinear strand during transport through the printing units.

If digital printing units are used, then endless conveyor belts are most suitably employed as the transport system.

In order to be able to carry out multicolor perfecting with the printing press according to the invention, a number of printing units for recto printing (first-side print) and a number of printing units for verso printing (back-side print) are disposed inline along the sheet transport path. The verso-printing units are disposed on a different side of the substrates from the printing units for recto printing.

In order to permit the use of identical printing units, it may be necessary for the recto and verso printing units to be disposed on the same side of the substrates. This can be accomplished through the interposition of a suitable turning device. The transport paths from the feeder to the turning apparatus and from the turning apparatus to the delivery each extend rectilinearly in the same plane.

According to the invention, various turning devices for turning the substrates in the printing press are provided which do not deform the substrates when they are turned. Turning devices according to the invention comprise a turning unit being rotatable about a center axis thereof, the turning unit having two mutually parallel rollers, the rollers being spaced apart by a distance being greater than a maximum length of a substrate to be turned, and an endless turning belt for the substrates, the turning belt being guided around the rollers.

In accordance with further features of the invention, the turning unit is rotatable through 180° or it is indexable in increments of 180°.

Another turning device according to the invention includes a rotatable turning pocket defining at least one substantially rectangular compartment, the compartment being slightly larger than a maximum size of a substrate to be turned and having three essentially open sides and one closed side, the closed side extending along an axis about which the turning pocket is rotatable.

In accordance with another feature of the invention, the at least one compartment is one of a plurality of compartments, the compartments being disposed in a star-shape about the axis about which the turning pocket is rotatable. Furthermore, the at least one compartment may be formed with one or more stops for holding substrates that are transported into the turning pocket, and including a plurality of grippers for ejecting the substrates from the turning pocket, the grippers being disposed along an open side of the compartment disposed opposite the closed side. The grippers preferably revolve around mutually spaced-apart gripper shafts and project into consecutive the compartments when the gripper shafts are rotated in synchronism with the turning pocket.

In an alternative embodiment of the turning device, there are provided a plurality of mutually parallel pairs of driveable transport rollers, the transport-roller pairs being mutually spaced apart by respective distances being smaller than a length of the substrates to be turned, all of the transport-roller pairs being commonly rotatable about an axis passing through each of the transport-roller pairs perpendicularly the transport-roller pairs.

In a preferred embodiment, the turning apparatus further comprises a drum-shaped housing having ends and defining a longitudinal axis, the transport-roller pairs being driveably held in the housing, the housing being open at the ends and being rotatable about the longitudinal axis, the longitudinal axis being coaxial with the axis passing perpendicularly through each of the transport-roller pairs.

In yet another embodiment of the turning device there are provided a plurality of pairs of driven transport rollers, the transport-roller pairs being disposed behind each other and being spaced apart by distances being smaller than a length of the substrates to be turned, mutually adjacent transport-roller pairs being offset with respect to each other by an angle being a fraction of 180°, the plurality of with the result that there is formed a spiral transport path of the substrates through the turning apparatus with a total angle of rotation of 180°.

In accordance with concomitant features of the invention, the above-described turning devices are incorporated in printing machines with rectilinear sheet transport as described above.

Other features which are considered as characteristic for the invention are set forth in the appended claims.

Although the invention is illustrated and described herein as embodied in a printing press with rectilinear substrate transport and turning devices therefor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
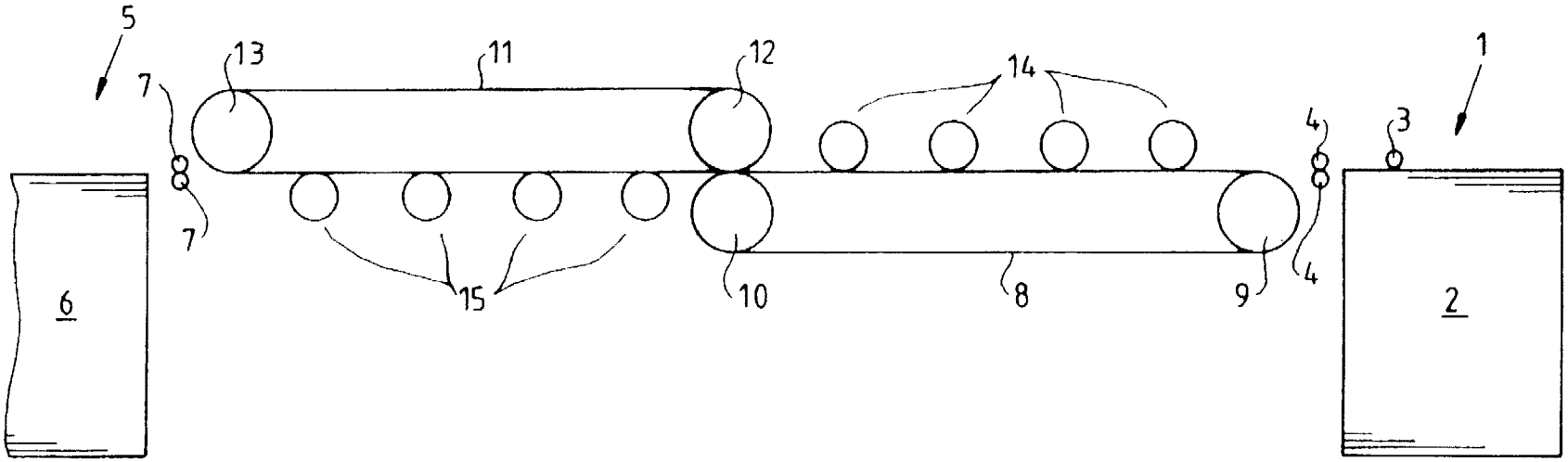
FIG. 1 is a schematic side view of a printing press for flat substrate transport with distributed printing units for recto and verso printing.

Referring now to the figures of the drawing in detail and first, particularly, to FIG. 1 thereof, there is seen a printing press which includes a feeder 1 with a height-adjustable feeder pile 2 on which the substrates or sheets to be printed are stacked. The terms substrates and sheets will be used indiscriminately herein, each referring to materials to be printed and formed of paper, sheet metal, glass panes, etc. The feeder of the printing press further includes substrate-removal rollers 3 and a pair of transfer rollers 4. A delivery 5 includes a height-adjustable delivery pile 6, a pair of transfer rollers 7 and a non-illustrated braking apparatus. In its simplest form, the braking apparatus may be a stop at the rear end of the delivery pile 6 in the longitudinal direction of the print press.

Disposed one behind the other-between the feeder 1 and the delivery 5 are a first endless conveyor belt 8 which is deflected around guide pulleys 9 and 10, and a second endless conveyor belt 11, which is deflected around guide pulleys 12 and 13. The upper strand of the conveyor belt 8 and the lower strand of the conveyor belt 11 lie one behind the other in the same plane, the conveyor belts 8, 11 contacting each other at a point on the circumference of the guide pulleys 10, 12. Four printing units 14 for recto printing are disposed one behind the other above the first conveyor belt 8; and four printing units 15 for verso printing are disposed one behind the other below the second conveyor belt 11. The printing units 14, 15 are schematically shown merely in the form of cylinders that transfer the inks from the printing units 14, 15 onto substrates. The substrates thereby lie on the upper strand of the conveyor belt 8 or on the lower strand of the conveyor belt 11

In operation, the substrates are removed consecutively from the feeder pile 2 by the substrate-removal rollers 3, are accelerated by the transfer rollers 4 and are conveyed onto the first conveyor belt 8, which runs around the guide pulleys 9, 10 in a counter-clockwise direction in FIG. 1. The substrates are transported along the printing units 14 by friction between the cylinders of the printing units 14 and the conveyor belt 8 and are printed on one side. At the point of contact between the conveyor belts 8, 11, the substrates part from the conveyor belt 8 and pass to the conveyor belt 11. The conveyor belt 11 conveys the substrates along the printing units 15 in the direction of the arrow, for example, by friction between the cylinders of the printing units 15 and the conveyor belt 11, the substrates being printed on the other side. On reaching the guide pulley 13, the substrates part from the conveyor belt 11 and pass between the pair of transfer rollers 7 in order to be deposited on the delivery pile 6.

With the exception of a possible slight offset which may be required in the case of thicker substrates, the surface of the upper strand of the conveyor belt 8 and the surface of the lower strand of the conveyor belt 11 lie in the same plane. The feeder pile 2 is moved during operation in such a manner that the uppermost substrate always lies in that same plane. At the delivery end it is merely necessary for the two transfer rollers 7 to adjoin that plane (where appropriate, a substrate brake will also suitably be disposed), and the released substrates are able to drop onto the delivery pile 6, the top side of which is kept, during operation, slightly below the plane of the transport of the substrates through the printing units 14, 15.

In this manner, the substrates undergo the printing process without any deformation. As a result, it is also possible for very thick, very stiff, or very fragile materials to be printed on both sides in multicolor in one operation.

If the printing units 14, 15 and the transfer rollers 4, 7 are disposed one behind the other at a distance smaller than the length of the substrates, thick or stiff substrates are kept on the transport path without the need for further measures. In order also to allow the printing of shorter or flexible substrates using the same printing press, the conveyor belts 8, 11 may be provided with means that, for example, produce electrostatic forces or vacuum, with the result that the substrates adhere to the rectilinear strands of the conveyor belts 8, 11, yet again detach themselves from the conveyor belts 8, 11 when they reach the guide pulleys 10/13. If required, the substrates may be held on the belts 8 and 11, respectively, by electrostatic charge forces, suction grippers, mechanical grippers, clamps, or the like.

Should it be the case that only recto printing is required, the printing units 15 and the conveyor belt 11 are omitted and the delivery 5 is disposed directly at the end of the conveyor belt 8. Furthermore, it is possible for the number of printing units to be varied at will for each substrate side.

The printing units 14, 15 may be any conventional printing units, e.g. offset printing units; alternatively, they may be digital printing units. In digital printing, endless belts are particularly suitable for the sheet transport. Alternatively, conventional substrate-transport apparatus employing chains and grippers also enter into consideration for the transport system.

Frequently, it is desirable to employ printing units of precisely identical construction, the printing parts of which are all disposed on one side of the substrate-transport path. This case is shown in FIG. 2, in which elements that conform to the printing press of FIG. 1 are identified by identical reference numerals.

Figure 2:
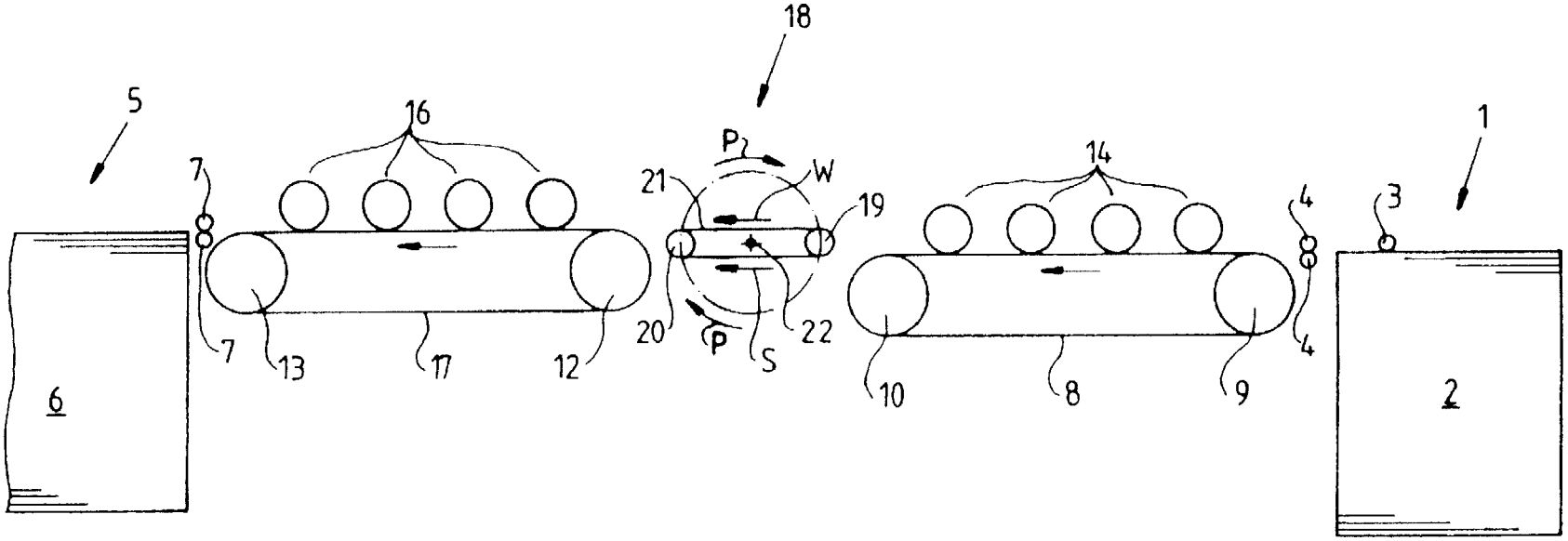
FIG. 2 is a similar view of a printing press with flat substrate transport and identical printing units for recto and verso printing and a turning apparatus for turning the substrates.

In FIG. 2, four printing units 16 are used for verso printing, said printing units 1S being disposed above a conveyor belt 17, i.e. in the reverse orientation to FIG. 1. In FIG. 2, the upper strand of the conveyor belt 17 lies in the same plane as the pair of transfer rollers 7 of the delivery 5. The conveyor belt 8 and the conveyor belt 17 are disposed at a distance apart in the direction of the length of the printing press, a turning unit 18 is disposed in the space formed between the guide rollers 10 and 12. The turning unit 18 consists of two rollers 19, 20, which are disposed at a distance apart that is greater than the maximum proposed substrate length, and of an endless turning belt 21, which runs around the rollers 19, 20. The turning unit 18 is rotatable as a whole about an axis 22 extending between the rollers 19, 20 and parallel to the rotational axes thereof. The upper strand of the conveyor belt 8 and the upper strand of the conveyor belt 17 are parallel, but are offset with respect to each other in the direction of the height of the printing press by a distance corresponding to the thickness of the turning unit 18, i.e. essentially to the diameter of the rollers 19, 20.

With the printing press shown in FIG. 2 in operation, the substrates are first of all printed on their first sides by the printing units 14, as has been described in conjunction with FIG. 1, and they then pass onto the turning belt 21, which is driven in synchronism with the conveyor belt 14 (arrow S) by a non-illustrated drive. Once the substrate is in contact over its entire length with the turning belt 21, the substrate, for example, adhering to the turning belt 21 through electrostatic forces or through vacuum, the turning belt 21 stops and the turning unit 18 as a whole is rotated through 180° about the axis 22 by a non-illustrated drive, as is indicated by arrows P. Subsequently, the turning belt 21 restarts in the opposite direction (arrow W) and transfers the substrate to the conveyor belt 17 with the printing units 16. The delivery of the substrates is identical to that described in conjunction with FIG. 1.

The particular design of the turning unit 18 makes it possible for the substrates to pass without deformation through a printing press of the kind shown in FIG. 2, i.e. with identical printing units.

Figure 3:
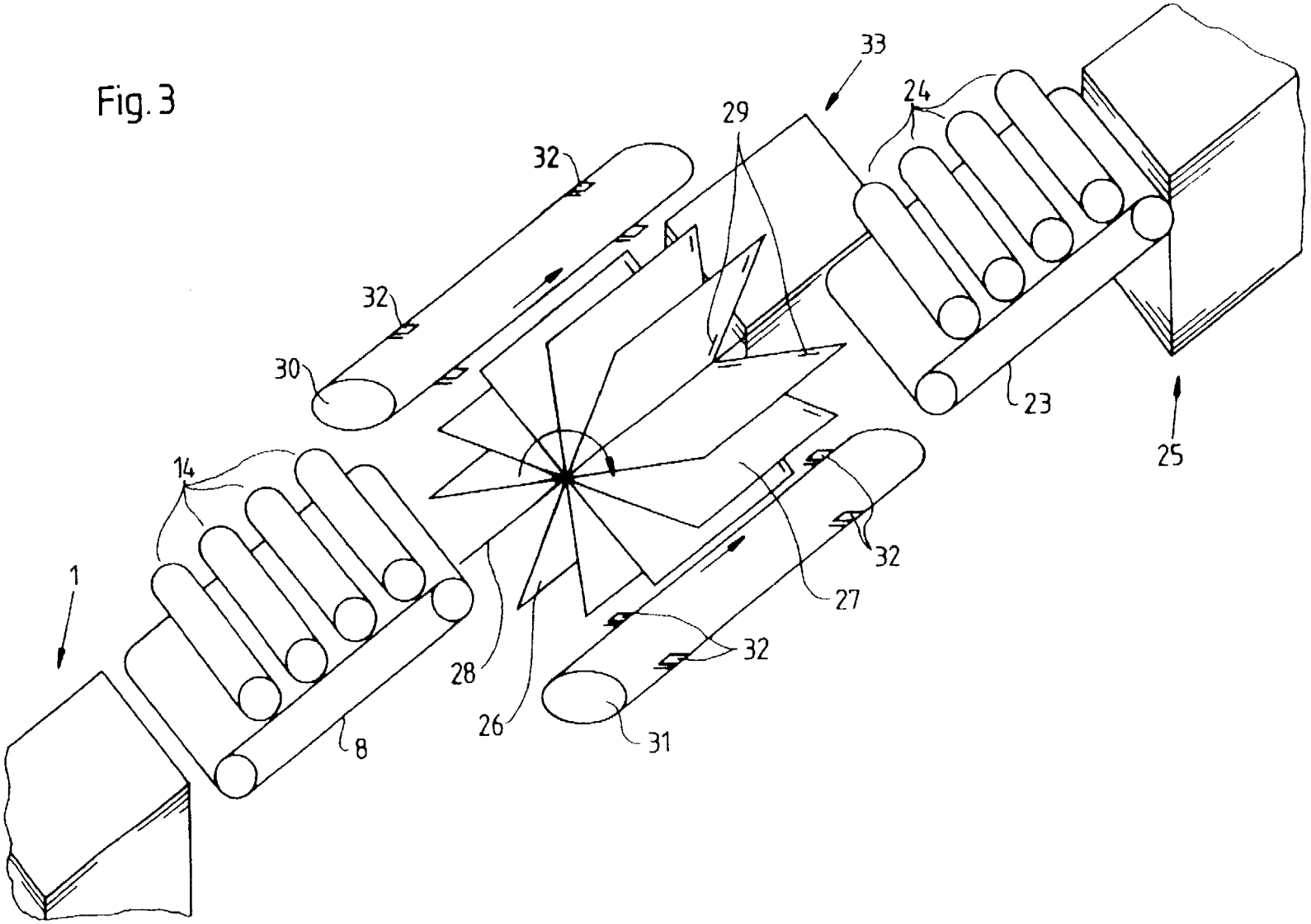
FIG. 3 is a schematic perspective view of a printing press for flat substrate transport with printing units for recto and verso printing and with a further embodiment of a turning apparatus.

A further turning apparatus which leaves the substrates flat when they are turned is shown in FIG. 3, which provides a perspective view of a printing press similar to that in FIG. 2 and in which elements that conform to elements in FIG. 2 are identified by identical reference numerals.

The printing press shown in FIG. 3 encompasses the conveyor belt 8 and the printing units 14 for recto printing—which, in conjunction with the feeder 1, form a first transport path—and a conveyor belt 23 and printing units 24 for verso printing—which, in conjunction with a delivery 25 for verso printing, form a second transport path. The first and second transport paths extend parallel to each other at the same height; however, in a sideways direction (transversely to the first and second transport paths), they are offset with respect to each other by slightly more than the width of a substrate.

A turning pocket 26 is disposed in a space between the conveyor belt 8 and the conveyor belt 23. The schematically represented turning pocket 26 is a rotationally symmetrical element with a number of compartments 27, which are disposed in star-like manner around an axis 28. The axis 28 extends parallel to the first and second transport paths and in the center therebetween. The turning pocket 26 is rotatable about the axis 28. Each compartment 27 comprises essentially rectangular sides corresponding to the maximum size of substrate to be accepted and—with the exception of one side that adjoins the axis 28—is open on all sides. With the turning pocket 26 in a defined position, a compartment 27 lies in an extension of the first transport path through the printing units 14 for recto printing and a compartment 27 opposite with respect to the axis 28 lies in an extension of the second transport path through the printing units 24. Each compartment 27 of the turning pocket 26 comprises schematically represented stops 29 on the side towards the second transport path.

Situated on the circumference of the turning pocket 26 and slightly outside of the radius of rotation thereof are, at the level of the first transport path through the printing units 14 two gripper shafts 30 and, at the level of the second transport path through the printing units 24, two gripper shafts 31. The gripper shafts 30, 31 are each spaced apart from each other in the direction of the axis 28 and are drivable about axes that are parallel to each other and perpendicular with respect to the axis 28. An endless transport apparatus (not separately shown) runs around each of the gripper shafts 30 and 31. Attached to each of the transport apparatus at intervals are a plurality of grippers 32, which, with the turning pocket 26 in a defined position, are each able to reach into and grip a sheet in one of the compartments 27 thereof. The gripper shafts 30, 31 and the grippers 32 comprise driving means (not shown) for rotation and for gripping.

A further delivery 33 for recto printing is disposed behind the turning pocket 26 in an extension of the first transport path through the printing units 14.

With the printing press and turning apparatus shown in FIG. 3 in operation, a substrate that has been singled from the feeder 1 is printed on one side by the printing units 14 for recto printing and is then inserted against the stops 29 into a compartment 27 of the turning pocket 26, said compartment 27 lying on a straight line with the first transport path through the printing units 14. Should it be desired that the respective substrate be printed only on the first side, the grippers 32, revolving around the gripper shafts 30, grip the substrate and convey it to the delivery 33. Should it be desired that the substrate be printed on both the first and back sides, the turning pocket 26 rotates further in phase with the printing press. For this purpose, the turning pocket 26 has a timed drive (not shown), which stops respective compartments 27 in an extension of the respective transport paths while the substrates are inserted or ejected. Once the substrate (to be printed on the first and back sides) lies on a straight line with the second transport path for verso printing, it is gripped by the grippers 32, which revolve around the gripper shafts 31, and is transferred to the printing units 24 for verso printing, which then print the second side of the substrate and convey the substrate to the delivery 25.

The gripper shafts 30, 31 rotate in synchronism with the turning pocket 26, with the result that, on one cycle, two successive grippers 32 engage a compartment 27 of the turning pocket 26 and, on the next cycle two other grippers 32 engage the following compartment 27 of the turning pocket 26.

With the turning pocket 26 shown in FIG. 3, the substrates are able to pass through the printing press without deformation, just as in the case of the preceding embodiment.

Furthermore, the exemplary embodiment shown in FIG. 3 has the advantage that there are different substrate-transport paths for recto and verso printing, this permitting substrates to be removed separately according to recto printing and verso printing. Moreover, a modular construction of the printing press is possible. Finally, the printing press and/or the turning apparatus can be incorporated in a most advantageous manner into on-line operation with pre- or post-processing machines of many different kinds.

Figure 4:
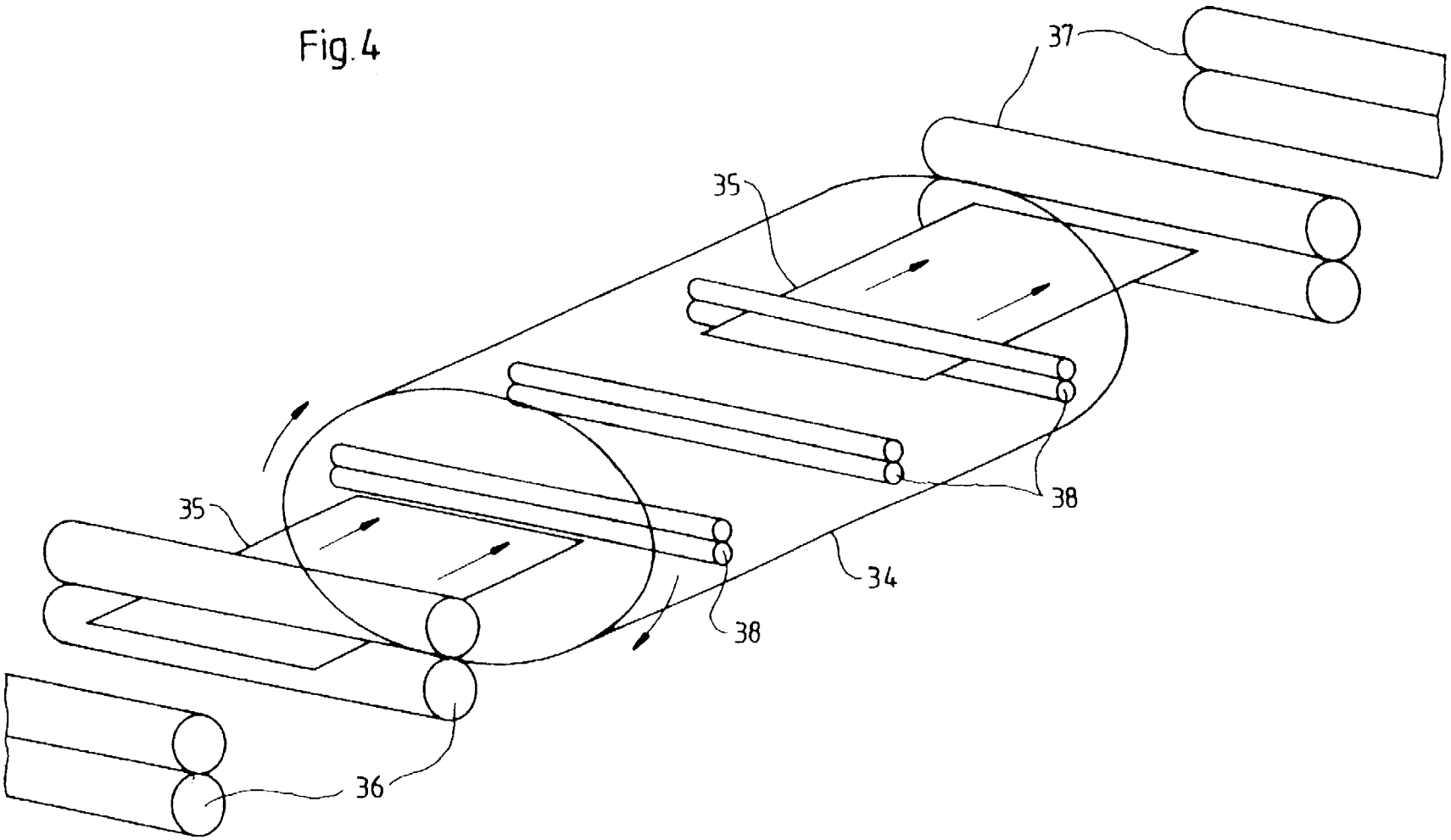
FIG. 4 is a partial perspective view illustrating another embodiment of a turning apparatus.

A further turning apparatus which leaves the substrates flat when they are turned is shown in FIG. 4, which is a perspective view of a portion of a printing press similar to that of FIG. 2.

The turning apparatus shown in FIG. 4 comprises a drum-shaped housing 34 with open ends. The longitudinal axis of the housing 34 extends through the center of a transport path of substrates 35 through a plurality of printing units 36 for recto printing and through a plurality of printing units 37 for verso printing. Between the printing units 36 and the printing units 37 there is a space that is greater than the length of a substrate 35. The housing 34 is disposed in the space.

A plurality of pairs of transport rollers 38 are located inside the drum-shaped housing 34. The rollers extend from wall to wall and perpendicularly with respect to the longitudinal axis thereof are. The pairs of transport rollers 38 are disposed one behind the other in the direction of the longitudinal axis of the housing 34 and are separated from each other and from the nearest printing unit 36, 37 by distances that are smaller than the length of the substrates 35. In the position shown in FIG. 4, the transport-roller pairs 38 lie in the same plane as the printing units 35, 37.

The drum-shaped housing 34 is rotatable about its longitudinal axis and is connected to a non-illustrated drive, through which drive the housing 34 is rotated through 180° backwards and forwards or indexed in increments of 180° in one direction. The transport rollers 38 are either connected in their horizontal positions to a non-illustrated drive disposed outside of the housing 34, or they have one or more drives that are disposed inside the housing 34 and are rotatable together therewith.

In operation, the substrates 35 are printed on one side by the printing units 36 and are then transported into the housing 34 by friction between the cylinders of the printing units 36. After a substrate 35 has been gripped by the first transport-roller pair 38 and has been released by the printing units 36, the housing 34 rotates through 180° about the transport direction of the substrate 35, the transport rollers 38 continuing to rotate inside the housing 34. The housing 34 may included non-illustrated guides that guide the substrates 35 on their path between the transport-roller pairs 38. The rotation speed of the housing 34 is designed such that, at the end of the 180° rotation, at which the housing 34 stands still for a moment, the substrate 35 is precisely at the end of the housing 34 or between the last transport-roller pair 38, from where it is then transferred to the printing units 37, which print it on the other side.

The timing of the rotation of the housing is controlled in such a manner that there is only one substrate 35 in the housing 34 at a time while said housing 34 rotates. The housing 34 is either always rotated in the same direction or is rotated backwards and forwards. In the latter case, the transmission of driving motions to the housing 34 is facilitated.

The specimen embodiment in FIG. 4 has the advantage that the substrates 35 can be turned without acceleration or deceleration in the substrate-transport direction. This makes it possible also for very sensitive substrates to be turned essentially in a force-free manner, such as thin glass plates, and, just as in the above-described exemplary embodiments, for them to be printed without deformation if the feeder and the delivery are disposed, as also described above, in such a manner as to ensure a rectilinear substrate-transport path. Furthermore, the embodiment shown in FIG. 4 allows very high speeds to be achieved.

Figure 5:
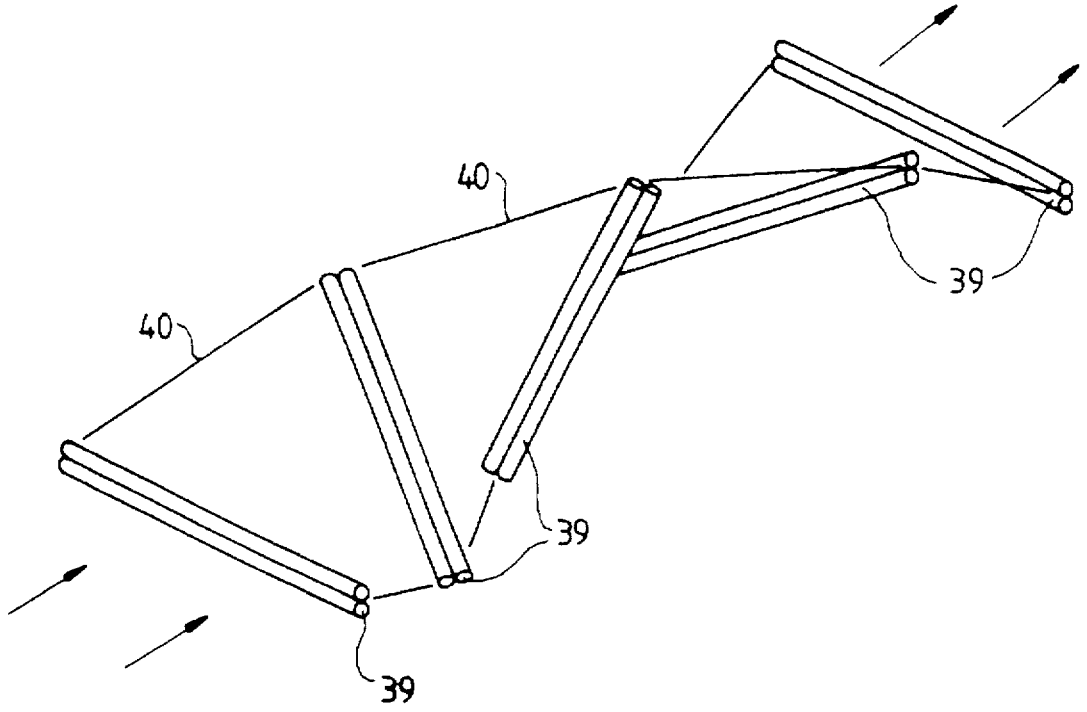
FIG. 5 is a diagrammatic perspective view of an alternative embodiment of a turning apparatus.

A modification of the turning apparatus from FIG. 4 is schematically represented in FIG. 5. In FIG. 5, five transport-roller pairs 39 are disposed one behind the other along a substrate-transport path indicated at the start and end by arrows, each two successive transport-roller pairs 39 being offset with respect to each other by an angle of approx. 45°, with the result that there is formed a spiral transport path with a total rotation angle of 180°. The relative offset angle between mutually adjacent rollers depends on the number of such roller pairs 39 provided between the mutually parallel roller pairs at the beginning and at the end of the turning device, i.e. the relative offset corresponds to 180° divided by the number of roller pairs plus one. Non-illustrated guides at the edge 40 of the transport path through the turning apparatus ensure that the substrates are not deformed or are deformed only insignificantly during transport and at transfer between the individual transport-roller pairs 39. This exemplary embodiment is distinguished in that only few moving parts are required.

We claim:

1. In a printing press for printing substrates having a maximum size, a turning device for turning the substrates in the printing press, comprising:

a rotatable turning pocket defining a plurality of substantially rectangular sheet receptacles, said receptacles being slightly larger than a maximum size of a substrate to be turned, being formed with one or more stops for holding substrates that are transported into said turning pocket, and having three essentially open sides and one closed side, the closed side extending along an axis about which said turning pocket is rotatable;

a plurality of grippers for ejecting the substrates from said turning pocket, said grippers being disposed along an open side of said sheet receptacles disposed opposite the closed side; and wherein said sheet receptacles are rotatable with said turning device about the axis, and wherein said grippers revolve around mutually spaced-apart gripper shafts and project into consecutive said sheet receptacles when said gripper shafts are rotated in synchronism with said turning pocket.

2. The turning apparatus according to claim 1, wherein said sheet receptacles are disposed in a star-shape about the axis about which said turning pocket is rotatable.

3. A printing press, comprising:

a plurality of in-line printing units defining a substantially rectilinear transport path, said printing units including a plurality of recto printing units and a plurality of verso printing units disposed along said transport path;

a transport system for transporting substrates for printing in said printing units along said transport path, said transport system including a first transport apparatus transporting the substrates through said recto printing units, and a second transport apparatus transporting the substrates through said verso printing units;

a feeder assembly for feeding the substrates to be printed from a feeder pile to said transport system; and a turning apparatus for turning the substrates disposed between said first transport apparatus and said second transport apparatus; said turning apparatus comprising a rotatable turning pocket defining at least one sheet receptacle, said sheet receptacle being slightly larger than a maximum size of a substrate to be turned and having three essentially open sides and one closed side, the closed side extending along an axis about which said turning pocket is rotatable.

* * * * *